US010466631B1

(12) United States Patent
Owaki et al.

(10) Patent No.: US 10,466,631 B1
(45) Date of Patent: Nov. 5, 2019

(54) FIXING DEVICE AND IMAGE FORMING APPARATUS

(71) Applicant: CANON KABUSHIKI KAISHA, Tokyo (JP)

(72) Inventors: Yusuke Owaki, Moka (JP); Hirotaka Fukushima, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/434,484

(22) Filed: Jun. 7, 2019

(30) Foreign Application Priority Data

Jun. 15, 2018 (JP) ..... 2018-114926
Apr. 22, 2019 (JP) ..... 2019-080722

(51) Int. Cl.
*G03G 15/20* (2006.01)

(52) U.S. Cl.
CPC ..... *G03G 15/2057* (2013.01); *G03G 15/2053* (2013.01); *G03G 15/2064* (2013.01); *G03G 2215/2035* (2013.01); *G03G 2215/2038* (2013.01); *G03G 2215/2048* (2013.01)

(58) Field of Classification Search
CPC ..... G03G 15/2053; G03G 15/2057; G03G 15/2064; G03G 2215/2035; G03G 2215/2038; G03G 2215/2048
See application file for complete search history.

(56) References Cited

U.S. PATENT DOCUMENTS

| | | | | |
|---|---|---|---|---|
| 9,274,470 | B2 | 3/2016 | Nakayama | |
| 9,448,502 | B2 * | 9/2016 | Taniguchi | G03G 15/0233 |
| 9,645,517 | B2 * | 5/2017 | Sato | G03G 5/087 |
| 2006/0216077 | A1 * | 9/2006 | Komuro | G03G 15/206 399/328 |
| 2012/0141162 | A1 * | 6/2012 | Mayuzumi | G03G 15/0233 399/111 |
| 2018/0181037 | A1 * | 6/2018 | Kataoka | G03G 15/2053 |
| 2019/0056686 | A1 * | 2/2019 | Yagi | G03G 15/2053 |

FOREIGN PATENT DOCUMENTS

| | | | |
|---|---|---|---|
| JP | 7-129001 | A | 5/1995 |
| JP | 2003-57978 | A | 2/2003 |
| JP | 2008-116612 | A | 5/2008 |
| JP | 2008-122442 | A | 5/2008 |
| JP | 2010-122450 | A | 6/2010 |
| JP | 2015-34980 | A | 2/2015 |

* cited by examiner

*Primary Examiner* — Ryan D Walsh
(74) *Attorney, Agent, or Firm* — Venable LLP

(57) ABSTRACT

A fixing device capable of stably performing a fixing operation for a long time is provided. The fixing device includes a cylindrical fixing belt and a heater. The fixing belt includes a resin layer forming an inner circumferential surface contactable with the heater. The heater includes a surface layer forming a sliding surface sliding on the fixing belt. The surface layer is an amorphous carbon film containing graphite particles. The sliding surface includes protrusions derived from the graphite particles. The protrusions have a distribution density of 50 to 2000 per 1 square millimeter of the sliding surface.

7 Claims, 9 Drawing Sheets

FIXING DEVICE AND IMAGE FORMING APPARATUS

BACKGROUND

The present disclosure is directed to a fixing device and an image forming apparatus including the fixing device.

DESCRIPTION OF THE RELATED ART

In recent years, an image forming apparatus has been utilized that includes a heating apparatus employing a film heating method and providing energy saving of a copying machine and shortening of a warm-up time in a compatible manner (Japanese Patent Application Laid-Open No. 2003-57978).

The film heating method uses a thin fixing film with a low heat capacity as a member of a fixing device. This reduces a time needed to raise temperature to a value at which the film can be fixed, enabling the warm-up time to be shortened. Furthermore, the shortened warm-up time eliminates a need to constantly heat the fixing device in a standby state, allowing standby power to be reduced. This enables energy saving.

In the fixing device employing the film heating method, a thin, cylindrical fixing film and a pressure roller form a fixing nip portion. A ceramic heater disposed inside the fixing film heats the fixing film at the nip portion to heat and fix toner to a recording material. After this fixing operation, the fixing film and the ceramic heater disposed inside the fixing film repeatedly slide on each other while being constantly in pressed contact with each other.

In view of sliding property and heat conductivity, a polyimide film with a film thickness of less than approximately 20 μm is formed on an inner circumferential surface of the fixing film. However, repeated fixing operations disadvantageously cause the inner surface of the fixing film to be worn away to increase abrasion resistance, leading to an increased likelihood of inappropriate rotation of a fixing belt. Inappropriate rotation of the fixing belt causes noise and degradation of resultant images, thus ending the life of the fixing device. Thus, to improve the durability life of the fixing device, a fixing device known from Japanese Patent Application Laid-Open No. 2015-34980 includes a diamond-like carbon (DLC) film formed on a surface of a ceramic heater portion and having an SP3 bonding ratio of 40% or more and 90% or less.

According to Japanese Patent Application Laid-Open No. 2003-57978, a DLC coat layer having an SP3 bonding ratio of 80% is formed on the surface of the ceramic heater portion to improve wear resistance and suppress peel-off of the film, allowing durability to be improved. This enables high fixability to be retained.

Although the above-described DLC film formed on the surface of the ceramic heater portion allows improvement of the durability life of the fixing device employing the film heating method, the durability life has been desired to be further improved.

SUMMARY

An aspect of the present disclosure is directed to providing a fixing device capable of stably performing a fixing operation for a long time. Furthermore, another aspect of the present disclosure is directed to providing an image forming apparatus capable of stably forming a high-quality electrophotographic image.

According to an aspect of the present disclosure, there is provided a fixing device including a cylindrical fixing belt and a heater, the heater being disposed so as to contact with an inner surface of the cylindrical fixing belt, the fixing belt including a resin layer forming an inner circumferential surface contactable with the heater, the heater having a surface layer forming a sliding surface sliding with the inner surface of the cylindrical fixing belt, the surface layer being constituted by an amorphous carbon film containing graphite particles, the sliding surface including protrusions derived from the graphite particles, and the protrusions having a distribution density of 50 to 2000 per 1 square millimeter on the sliding surface.

Furthermore, according to another aspect of the present disclosure, there is provided an image forming apparatus including a fixing device heating an unfixed toner image formed on a recording material to fix the toner image to the recording material, the fixing device being the above-described fixing device.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

The present inventors studied use of graphite for further improving a sliding property of a contact portion between a fixing belt and a heater in a fixing device. The results of the study indicate that graphite particles contained in a surface layer of an amorphous carbon film allow self-lubricity of graphite to be achieved even in a case where the amorphous carbon film is slid on a material such as resin or rubber, which is softer than graphite.

In a material having a layered structure such as a crystal structure of graphite, layers of the material are easily cut away by shearing, causing reduced friction. Such a material is thus utilized as a self-lubricant.

However, in a case where graphite is slid on a material softer than graphite or an elastic material, the graphite is considered not to be scraped off. Thus, effectiveness of self-lubricity of graphite in such a case has been unknown.

Also in a case where graphite particles are contained in the surface layer of the amorphous carbon film, the amorphous carbon film is generally slid on a material harder than graphite. Sliding of the amorphous carbon film on a material softer than graphite, for example, resin, has been unknown.

A fixing device according to the present embodiment will be described below in detail with reference to the drawings.

Figure 1:
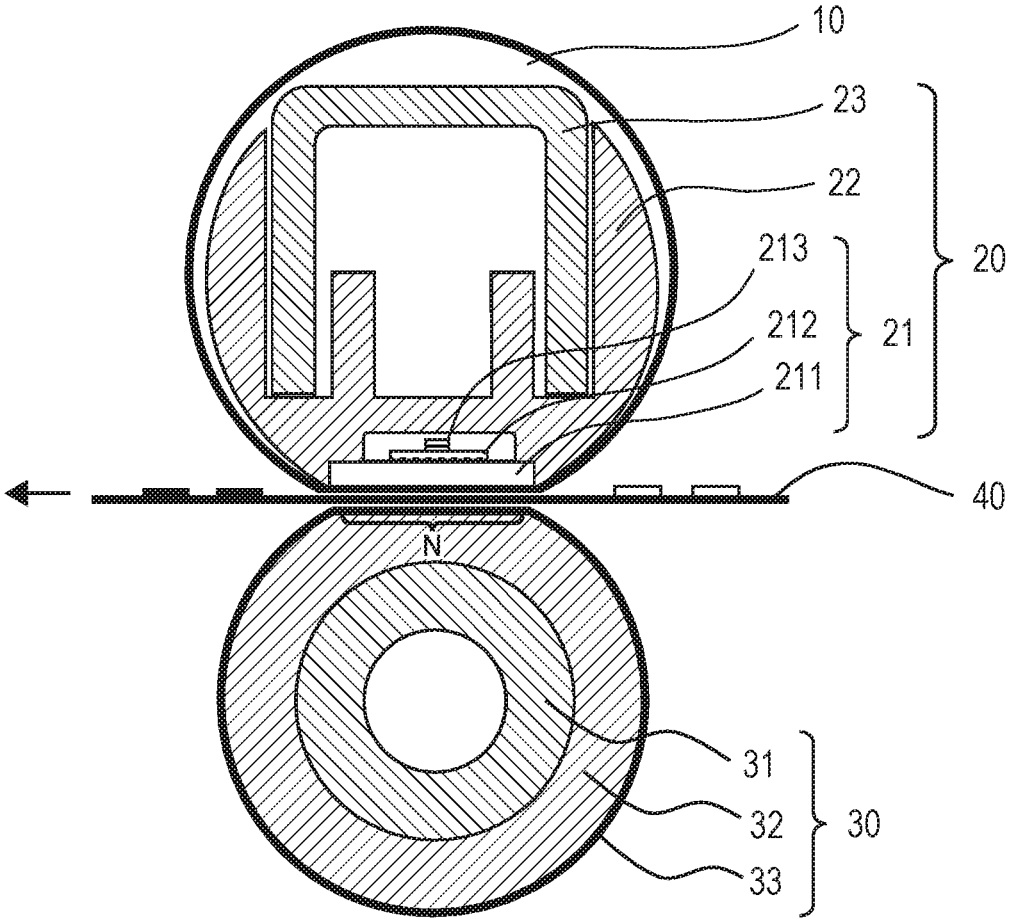
FIG. 1 is a schematic cross-sectional view of a fixing device according to the present embodiment.

A fixing device illustrated in FIG. 1 includes a fixing belt 10, a heater unit 20 disposed inside the fixing belt 10, and a pressure roller 30.

The heater unit 20 includes a heater 21 serving as a heat source, a heater holder 22 having a transverse section shaped like a semi-circular arcuate tub, and a reinforcing metal plate 23 having an inverted U-shaped transverse section.

The heater holder 22 is a member for supporting the heater 21, and the heater 21 is fixedly held by the heater holder 22. The heater holder 22 is formed of a liquid crystal polymer resin with high heat resistance.

The fixing belt 10 is formed of a heat-resistant cylindrical film having a cross-sectional diameter of approximately 30 mm. Furthermore, the fixing belt 10 is heated by the heater unit 20 and is rotatable. An inner circumferential surface of the fixing belt 10 that contacts with the heater 21 of the heater unit 20, is formed of a resin material.

The pressure roller 30 is also rotatable and forms a fixing nip portion N between the pressure roller 30 and the fixing belt 10 where a recording material 40 is held.

The heater 21 disposed inside the fixing belt 10 comes into contact with the inner circumferential surface of the fixing belt 10 and serves to heat the fixing belt 10 and press the fixing belt 10 against the pressure roller 30.

The reinforcing metal plate 23 is a member for preventing the heater 21 from being deformed in a case where the heater 21 is pressed by the pressure roller 30.

The pressure roller 30 includes core metal 31, an elastic layer 32 formed of silicone rubber, and a surface layer 33 formed of a fluorine-based resin.

Figure 2:
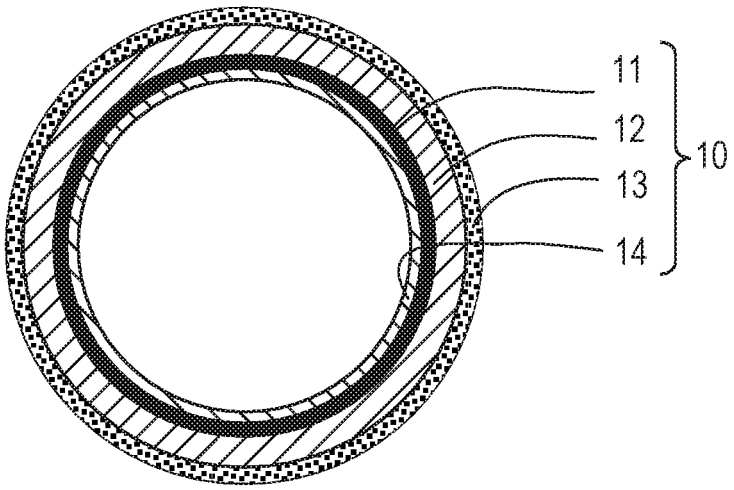
FIG. 2 is a cross-sectional view illustrating an example of a configuration of a fixing belt according to the present embodiment.

FIG. 2 illustrates a cross-sectional view of the fixing belt 10 illustrated in FIG. 1. The fixing belt 10 includes a cylindrical stainless-steel substrate 11 having a thickness of 30 μm, a silicone rubber layer (elastic layer) 12 coated on the substrate 11 and having a thickness of 300 μm, and a perfluoroalkoxy alkane (PFA) resin tube (outermost layer) 13 coated on the silicone rubber layer 12 and having a thickness of 20 μm. The fixing belt 10 includes a polyimide film 14 formed on a cylindrical inner circumferential surface of the fixing belt 10 to improve a sliding property and heat conductivity. The polyimide film 14 can be 20 μm or less in thickness in order to suppress a decrease in heat transfer efficiency.

Figure 3:
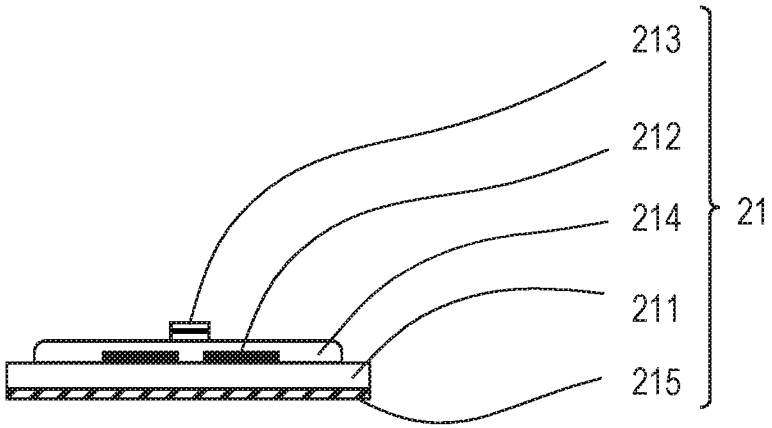
FIG. 3 is a cross-sectional view illustrating an example of a configuration of a heater according to the present embodiment.

FIG. 3 illustrates a structure of the heater 21 illustrated in FIG. 1 and a configuration of the heater. The heater 21 includes a heater substrate 211, a heating element 212, and a thermistor 213 used as a temperature sensor. The heater substrate 211 is a plate-like substrate shaped like a reed and having a longitudinal direction corresponding to a direction orthogonal to a conveying direction (the direction of an arrow in FIG. 1) for the recording material 40.

A material of the heater substrate 211 can be ceramics in view of an excellent insulation property, high heat resistance, and a low heat capacity. In particular, the material can be aluminum nitride or alumina. The substrate can have a thickness of, for example, 1.0 mm in order to obtain a needed heat conductivity and a needed strength. Surfaces of the heating element 212 can be coated with an overcoat layer 214 of glass, polyimide, or the like for protection.

Furthermore, the heater substrate 211 includes, in a front surface of the heater substrate 211, a surface layer 215 forming a sliding surface on which the inner circumferential surface of the fixing belt 10 slides. The surface layer 215 includes an amorphous carbon film containing graphite particles.

The surface layer 215 is preferably 0.20 μm or more and 0.90 μm or less and particularly preferably 0.35 μm or more and 0.65 μm or less. A method for measuring the film thickness of the surface layer will be described below.

The amorphous carbon film can be a diamond-like carbon (DLC) film containing substantially no hydrogen.

The surface layer 215 includes protrusions on a surface of the surface layer 215 forming the sliding surface, the protrusions being derived from the graphite particles. The graphite particles forming the protrusions preferably have a distribution density of 50 to 2000 and more preferably 200 to 1000 per 1 square millimeter of the surface layer.

The graphite particles can be discretely distributed over the surface of the amorphous carbon film while achieving an even distribution density. Furthermore, at least some of the graphite particles can be exposed in the surface of the amorphous carbon film. In the present embodiment, the graphite particles are spherical as described below. However, the graphite particles are not limited to the spherical shape and may be elliptic, cylindrical, or prismatic. Furthermore, the graphite particles can have a diameter of 0.19 to 3.1 μm.

Here, a method for forming, on the surface of the heater substrate 211, an amorphous carbon film containing graphite particles will be described. In the present embodiment, an arc plasma film forming method was used that is known as a method for forming an amorphous carbon film and in which a target material is evaporated in vacuum by arc discharge to deposit a film on a substrate. Arc discharge in vacuum causes a cathode target to emit an ionized cathode material and particles of the cathode material, which are referred to as droplets. The ionized cathode material and the droplets adhere to the substrate. At this time, in a case where the cathode material is black lead, the droplets are graphite particles and the graphite particles and the amorphous carbon film can be simultaneously formed on the substrate.

Figure 4A:
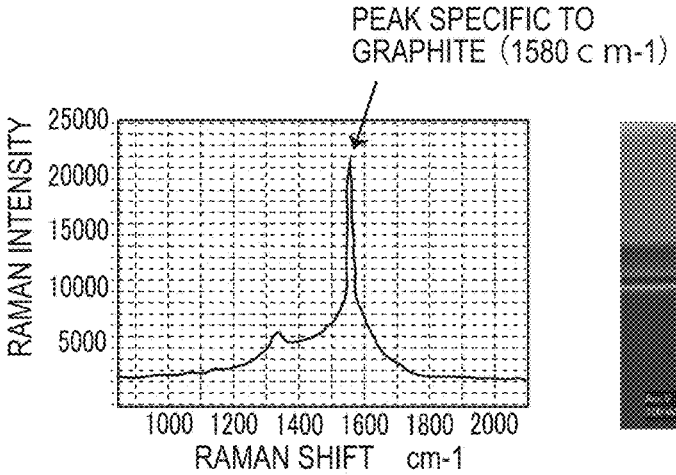
FIG. 4A is a diagram illustrating results of analysis of graphite particles according to the present embodiment.
Figure 4B:
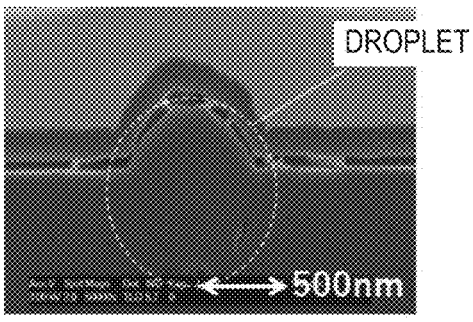
FIG. 4B is a diagram illustrating results of analysis of graphite particles according to the present embodiment.

FIGS. 4A and 4B illustrate results of analysis of droplets adhering onto the substrate in a case where black lead was used as a cathode material for film formation. FIG. 4A illustrate the results of analysis of a structure of droplets using a microscopic laser Raman spectroscopic apparatus. FIG. 4B illustrates the results of observation of a cross-sectional shape of the droplet using a focused ion beam apparatus and a scanning electron microscope.

In FIG. 4A, a Raman spectrum specific to graphite is observed and clearly indicates that droplets resulting from film formation using black lead as a cathode material are graphite.

Furthermore, FIG. 4B illustrates that the cross-sectional shape of the graphite particles clearly indicates that the graphite particles are spherical. Additionally, as illustrated in FIG. 4B, protrusions derived from the graphite particles are formed on the sliding surface of the surface layer.

In the present embodiment, the arc plasma film forming method using black lead as a material was used. However, besides the arc plasma film forming method, a sputtering film forming method, a laser ablation film forming method, or an electron beam evaporation method using black lead as a material can also be employed.

Figure 5A:
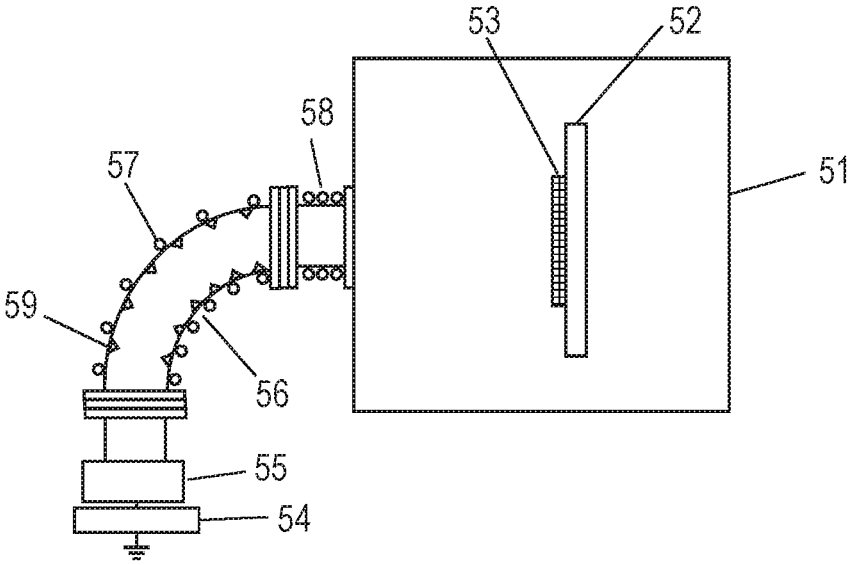
FIG. 5A is a schematic diagram illustrating an example of a film forming apparatus with the heater according to the present embodiment.
Figure 5B:
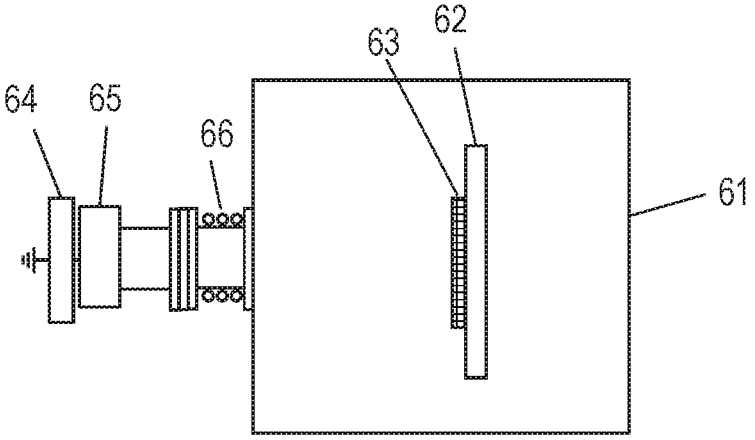
FIG. 5B is a schematic diagram illustrating an example of the film forming apparatus with the heater according to the present embodiment.

FIGS. 5A and 5B illustrate film forming apparatuses used for a process of forming an amorphous carbon film containing graphite particles according to an embodiment using the arc plasma film forming method. FIG. 5A illustrates a film forming apparatus using a filtered cathodic vacuum arc film forming method (FCVA film forming method). FIG. 5B illustrates a normal vacuum arc evaporation film forming apparatus including no filter. In the FCVA film forming method, droplets emitted from a cathode during arc discharge can be trapped and removed and formed into a film. Furthermore, as described below, the number of droplets per unit area (distribution density) can be varied by controlling filter conditions. In the present embodiment, the distribution density of graphite particles, which are droplets, were varied for examinations.

The film forming apparatus illustrated in FIG. 5A includes a vacuum chamber 51, a vacuum arc power supply 54 connected to the vacuum chamber 51, an arc plasma generation chamber 55, a plasma pipeline 56, a filter coil 57, and a scanning coil 58. The vacuum chamber 51 contains a substrate holding member 52 for holding a substrate 53. The arc plasma generation chamber 55 includes a vacuum arc evaporation source evaporating the cathode by vacuum arc discharge to generate plasma. The plasma pipeline 56, which has a bent shape, is used to connect the arc plasma generation chamber 55 and the vacuum chamber 51 together. The filter coil 57, which forms magnetic fields, is wound around the plasma pipeline 56. Furthermore, besides the filter coil 57, the scanning coil 58 is provided to polarize carbon ion beam for scanning. In the FCVA film forming method, bellows-like pleats (baffles) 59 used to trap and remove droplets are installed in the plasma pipeline 56. In the present embodiment, the shape of the baffles was varied for film formation.

Figure 6:
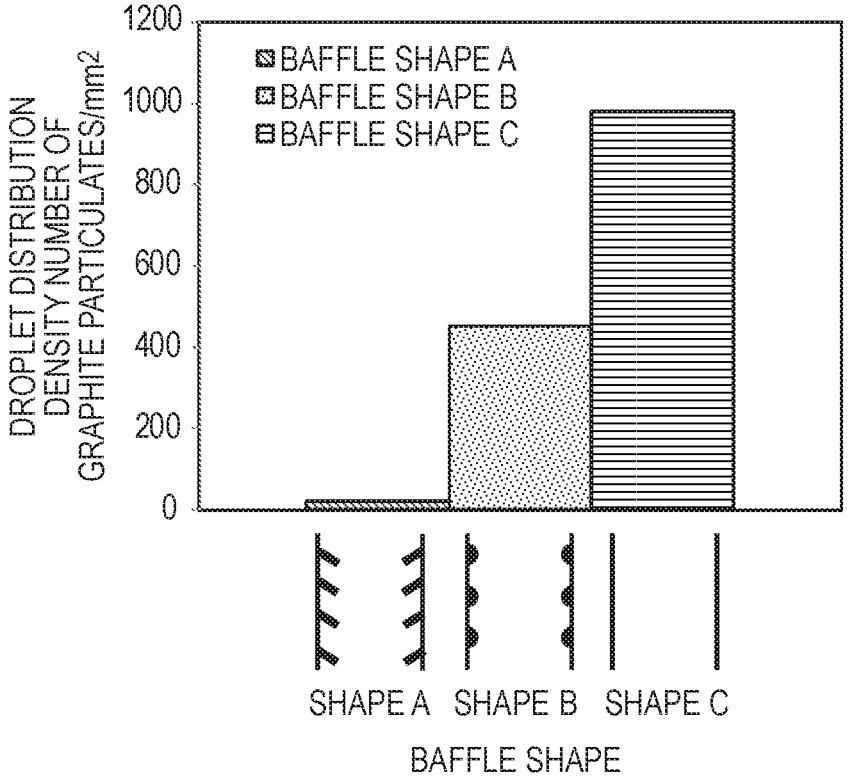
FIG. 6 is a diagram illustrating results of measurement of a distribution density of graphite particles in a case where a baffle shape is changed according to the present embodiment.

FIG. 6 illustrates the number of graphite particles per unit area; in this case, the graphite particles were formed on the substrate, with the shape of the baffle varied (cross-sectional view). Here, a baffle shape A is used for the normal FCVA film forming method. A baffle shape B includes relatively smaller pleats than the baffle shape A, and a baffle shape C includes no pleats. The baffle shape A includes pleats having a height of approximately 5 to 10 mm and arranged at a pitch of approximately 10 mm. The baffle shape B includes pleats having a height of less than 5 mm and arranged at a pitch of approximately 10 mm.

FIG. 6 clearly indicates that varying the shape of the baffles allows the distribution density of the graphite particles to be adjusted. The shape of the baffles is not limited to the shapes illustrated in the present embodiment.

Furthermore, in the present embodiment, the shape of the baffles was varied to adjust the number of droplets per unit area (distribution density). However, the distribution density of the droplets can also be adjusted using an arc discharge current, a bias voltage applied to a plasma pipeline (filter), or a time for irradiation of the substrate.

The shape of the plasma pipeline 56 is also not limited to the shape in the present embodiment, and a T-shaped filter or the like may be used. Furthermore, the method for filtering the droplets is not limited to the method in the present embodiment.

The film forming apparatus illustrated in FIG. 5B is substantially equivalent to the film forming apparatus in FIG. 5A except for the lack of the plasma pipeline. The film forming apparatus includes a vacuum chamber 61, a vacuum arc power supply 64 connected to the vacuum chamber 61, an arc plasma generation chamber 65, and a scanning coil 66. The vacuum chamber 61 contains a substrate holding member 62 for holding a substrate 63. Like the apparatus in FIG. 5A, the apparatus in FIG. 5B can adjust the distribution density of graphite particles using the arc discharge current or the time for irradiation of the substrate.

Now, a process of forming graphite particles and an amorphous carbon film using the apparatus in FIG. 5A will be described. The vacuum chamber 51 is evacuated using an unillustrated vacuum pump until the ultimate vacuum in the vacuum chamber 51 is $1\times10^{-5}$ Pa or less. Then, the vacuum arc power supply 54 is used to generate carbon plasma in the arc plasma generation chamber 55. A current passing through the filter coil 57 or the scanning coil 58 is controlled to a desired value to carry the carbon plasma onto the substrate 53 to form an amorphous carbon film. At this time, some of the graphite particles generated simultaneously with emission of carbon ions from the cathode are trapped and removed by the baffles 59 in the plasma pipeline 56, whereas the remaining graphite particles recoil and travel through the pipeline onto the substrate 53, on which graphite particles are formed.

A process of forming graphite particles and an amorphous carbon film using the apparatus in FIG. 5B is similar to the process in FIG. 5A. The vacuum chamber 61 is evacuated using an unillustrated vacuum pump until the ultimate vacuum in the vacuum chamber 61 is $1\times10^{-5}$ Pa or less. Then, the vacuum arc power supply 64 is used to generate carbon plasma in the arc plasma generation chamber 65. A current passing through the scanning coil 66 is controlled to a desired value to carry the carbon plasma onto the substrate 53 to form an amorphous carbon film. For the graphite particles generated simultaneously with emission of carbon ions from the cathode, only the graphite particles emitted toward the substrate arrive on the substrate, on which graphite particles are formed.

Now, a method for measuring the distribution density of graphite particles will be described. In the present embodiment, a surface observing apparatus (trade name: Surfscan 6420, manufactured by KLA-Tencor) was used for measurement. Based on the measured distribution of graphite particles on a substrate, the distribution density on the surface of the heater was calculated. The surface observing apparatus radiates and scans focused laser light on the surface of an amorphous carbon film including graphite particles, to determine the density, positions, and particle sizes of the particles based on an intensity profile of scattered light emitted from the graphite particles.

Figure 7:
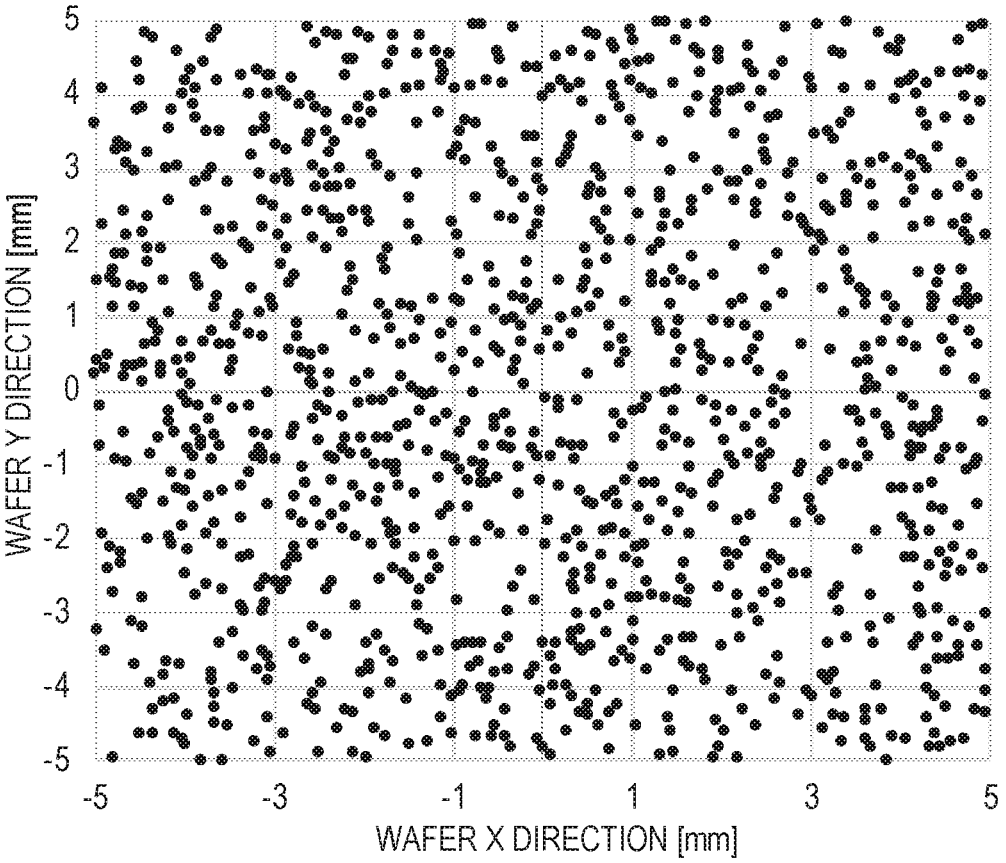
FIG. 7 is a diagram illustrating results of measurement of the distribution of graphite particles according to the present embodiment.

FIG. 7 illustrates an example of results of observation (an example of the results of observation of the distribution state of graphite particles on the substrate). The particles have a diameter ranging from 0.19 μm to 3.1 μm. Furthermore, FIG. 7 clearly indicates that the graphite particles are discretely distributed over the substrate while achieving an even distribution density.

Although, in the present embodiment, "Surfscan 6420" was used to measure the distribution density of graphite particles, a well-known scanning probe microscope or scanning electron microscope can be used for measurement as a surface observing apparatus.

<Sheet Passing Durability Tests>

Now, a method for sheet passing durability tests using the fixing device illustrated in FIG. 1 will be described. Opposite ends of the core metal 31 of the pressure roller 30 are rotatably held by bearings between inner and outer side plates of an unillustrated apparatus frame. The pressure roller 30 is rotationally driven counterclockwise by an unillustrated driving system while being pressed by an unillustrated pressing unit. As a result, the fixing belt 10 slides in close contact with the surface of the substrate of the heater 21, while being rotationally driven around the heater holder 22. In the tests in Examples and a Comparative Example described below, a load was controlled to apply a maximum pressure of 0.2 $N/mm^2$ to the sliding surface of the heater. Furthermore, the unillustrated driving system was controlled to set a sliding speed to 350 mm/sec to conduct the tests.

A thermistor 213 is installed on a surface of the heater 21 opposite to the sliding surface to detect a temperature of the heater 21. Based on temperature information obtained by the thermistor 213, the temperature of the heater 21 is controlled while a current passing through the heating element 212 is being controlled using an unillustrated power supply. In the tests in the Examples and Comparative Example described below, the temperature of the heater 21 was controlled to 200° C.

Fluorine-based grease or fluorine-based oil is applied to the inner circumferential surface of the fixing belt 10 as a heat-resistant lubricant; the fluorine-based grease contains unillustrated perfluoropolyether (PFPE) as base oil and polytetrafluoroethylene (PTFE) as a thickener, and the fluorine-based oil contains PFPE. The inner circumferential surface of the fixing belt 10 and the surface of the heater substrate 211 are brought into sliding contact with each other with the lubricant between the inner circumferential surface and the heater substrate surface. In the Examples and Comparative Example described below, the fluorine-based grease containing PFPE as base oil and PTFE as a thickener was used. Besides the fluorine-based grease, heat-resistant grease, silicon-based heat-resistant oil, or the like can also be used as the heat-resistant lubricant.

Figure 8:
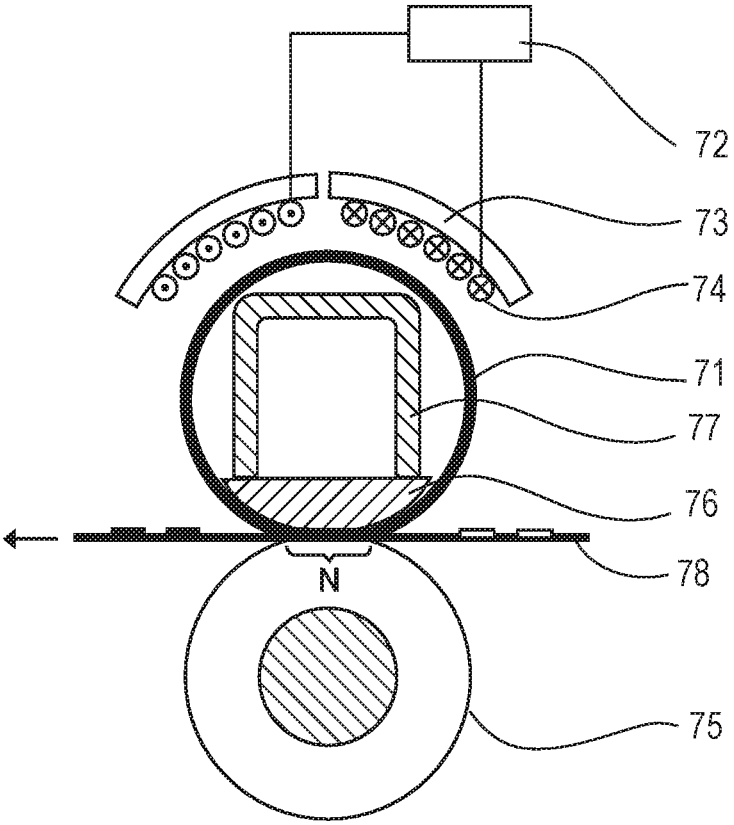
FIG. 8 is a schematic cross-sectional view illustrating an example of a fixing device according to the present embodiment.

Furthermore, another aspect of the fixing device according to the present disclosure, of which an induction heating method described in Japanese Patent Application Laid-Open No. 2010-122450, is employed, will be described. FIG. 8 is a cross-sectional view of the fixing device. The apparatus includes a fixing belt 71, an IH power supply 72, a core 73 and a coil 74, a pressure roller 74, a pressure member 76, and a pressure support member 77. The fixing belt 71 is formed of a conductive material and is rotatable. As is the case with FIG. 2, the inner circumferential surface of the fixing belt 71 is coated with a polyimide film with a thickness of 4 μm in order to improve a sliding property.

The pressure roller 75 is rotatable and forms a fixing nip portion N between the pressure roller 75 and the fixing belt 71 where a recording material 78 is held. The pressure member 76 is pressed toward the pressure roller by a pressure support member 77 with a U-shaped cross section. An amorphous carbon film containing graphite particles in a surface layer was formed on a surface (the surface of an area with a circular arcuate cross section) of the pressure member 76 that slides in contact with the inner circumferential surface of the fixing belt 71.

A method for paper passing durability tests using the apparatus in FIG. 8 will be described. Opposite ends of the pressure roller 75 are rotatably held by bearings between inner and outer side plates (the side plate closer to the reader in FIG. 8 and the side plate farther from the reader in FIG. 8) of an unillustrated apparatus frame. The pressure roller 75 is rotationally driven counterclockwise by an unillustrated driving system while being pressed by an unillustrated pressing unit. As a result, the fixing belt 71 slides in close contact with the surface of the pressure member 76, while being rotationally driven clockwise around the pressure member 76 and the pressure support member 77. An alternating current from the IH power supply 72 is passed through the coil 74 wound around the core 73 to generate magnetic fields, thus inductively heating the fixing belt 71. Furthermore, a heat-resistant fluorine-based lubricant was applied to the inner circumferential surface of the fixing belt 71 as a heat-resistant lubricant. Besides the fluorine-based lubricant, another heat-resistant grease, silicon-based heat-resistant oil, or the like can also be used as the heat-resistant lubricant.

Figure 9:
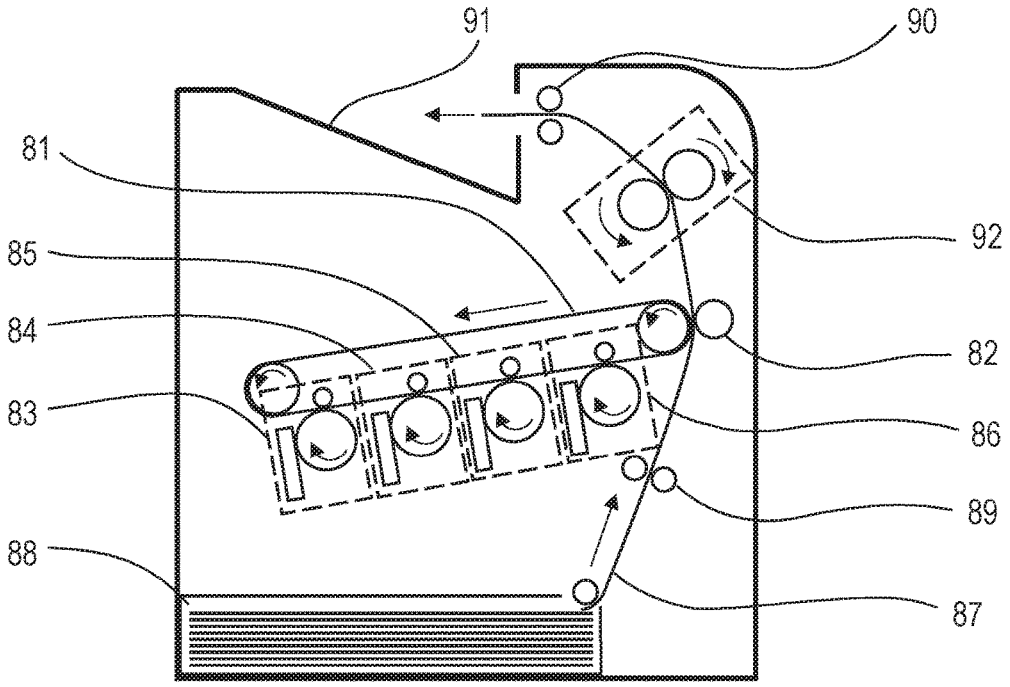
FIG. 9 is a schematic cross-sectional view illustrating an example of an image forming apparatus according to the present embodiment.

FIG. 9 is a schematic longitudinal sectional view illustrating a general configuration of an electrophotographic full-color printer that is an example of an image forming apparatus equipped with the fixing device according to the present aspect. The printer can form a full-color image on a recording material 87 according to input image information from an unillustrated external host apparatus, and output the image. The printer includes an intermediate transfer belt 81, a secondary transfer roller 82, four-color toner image forming units 83 to 86, a cassette sheet feeding unit 88, sheet feeding rollers 89, a discharging roller 90, a sheet discharging tray 91, and the fixing device 92 illustrated in FIG. 1. Recording materials 87 are stacked and accommodated in the cassette sheet feeding unit 88. A method for forming an image on the recording material 87 using the printer will be described.

First, based on image information input from the unillustrated external host apparatus, toner images are formed on drums of toner image forming units 83 to 86. Here, a process of forming toner images (electrophotographic process) is well known and will not be described. Furthermore, detailed description of configuration of the toner image forming units is also omitted. Four-color toner images formed on the drums of the toner image forming units 83 to 86 are transferred, in a superimposed manner, onto the intermediate transfer belt 81, rotationally driven by the unillustrated driving system. An unfixed full-color toner image is formed on the intermediate transfer belt 81 in a synthesized manner. Subsequently, the sheet feeding roller 89 conveys the recording material 87 from the cassette sheet feeding unit 88. A secondary transfer unit including the intermediate transfer belt 81 and the secondary transfer roller 82 secondarily transfers, onto the recording material 87, the full-color toner image on the intermediate transfer belt 81. The recording material 87 having passed through the secondary transfer unit is introduced into the fixing device 92, which melts the unfixed toner so as to mix the colors of the toner together, while pressing and fixing the toner image to the surface of the recording material 87. Finally, the recording material 87 having passed through the fixing device 92 is discharged onto the sheet discharging tray 91 by the sheet discharging roller 90.

According to an aspect of the present disclosure, a fixing device that can stably perform a fixing operation for a long time can be provided. Furthermore, according to another aspect of the present disclosure, an image forming apparatus capable of forming a high-quality electrophotographic image can be provided.

EXAMPLES

Example 1

First, the film forming apparatus illustrated in FIG. 5A was used to form an amorphous carbon film containing graphite particles, on the heater substrate 211 illustrated in FIG. 3, as a surface layer.

Specifically, the vacuum arc power supply 54 was used to allow an unillustrated graphite target to cause arc discharge, and resultant carbon ions were carried into the vacuum chamber 51 to form, on the heater substrate 211, an amorphous carbon film containing graphite particles. At this time, a current from the vacuum arc power supply 54 was controlled to 30 A and a bias voltage applied to the plasma pipeline 56 by an unillustrated power supply was controlled to 15 V to control the distribution density of the graphite particles. As a baffle shape, the shape B illustrated in FIG. 6 was used.

For a substrate produced under the above-described film formation conditions, the surface observing apparatus (trade name: Surfscan 6420, manufactured by KLA-Tencor) was used to measure the distribution density of graphite particles (diameter: 0.19 μm or more and 3.1 μm or less). The results of the measurement indicate that approximately 50 graphite particles were formed per 1 square millimeter Furthermore, the thickness of the surface layer was measured by the following method.

When a film was formed on the heater substrate 211, a silicon wafer for monitoring (manufactured by ELECTRONICS AND MATERIALS CORPORATION, size: 25 mm×20 mm, thickness: 0.6 mm, and surface roughness (Ra): 0.1 nm) was disposed near the heater substrate 211, and an amorphous carbon film was also formed on the silicon wafer. At this time, a part of a film formation surface of the amorphous carbon film on the silicon wafer surface was masked to avoid formation of an amorphous carbon film on this part. After the film formation, the silicon wafer was taken out, and a step between a film formation portion and a non-film-formation portion of the amorphous carbon film on the silicon wafer surface was measured using a probe type profiler (trade name: P-15, manufactured by KLA-Tencor). The obtained value was determined to be the thickness of the amorphous carbon film. The thus measured thickness of the amorphous carbon film was 0.5 μm.

Then, the fixing device illustrated in FIG. 1 was manufactured using the heater 21 including a heater substrate with a surface layer produced under the above-described film formation conditions. Paper passing durability tests were conducted using the fixing device. In the paper passing durability tests, the durability life was determined to end when noise resulted, for the first time, from inappropriate sliding between the fixing belt and the surface layer.

As a result, in the fixing device according to the present embodiment, the noise was not generated even when the time spent in the fixing operation was 500 hours or longer. Accordingly, the durability life was evaluated as 500 hours or longer.

Example 2

As is the case with Example 1, an amorphous carbon film containing graphite particles was formed on the heater substrate. However, a current from the vacuum arc power supply 54 was controlled to 50 A and a bias voltage applied to the plasma pipeline 56 was controlled to 10 V. Furthermore, as a baffle shape, the shape B illustrated in FIG. 6 was used.

For a surface layer produced under the above-described film formation conditions, the distribution density of graphite particles was measured as is the case with Example 1 using the same surface observing apparatus as that in Example 1.

Furthermore, a fixing device was produced as is the case with Example 1 except for the use of the heater 21 including the heater substrate with the surface layer produced under the above-described film formation conditions, and was used for paper passing durability tests. As a result, the noise was not generated even when the time spent in the fixing operation was 500 hours or longer. Accordingly, the durability life was evaluated as 500 hours or longer.

Example 3

As is the case with Example 1, an amorphous carbon film containing graphite particles was formed. However, the current from the vacuum arc power supply 54 was controlled to 50 A and the bias voltage applied to the plasma pipeline 56 was controlled to 10 V. Furthermore, as a baffle shape, the shape C illustrated in FIG. 6 was used.

For a surface layer produced under the above-described film formation conditions, the distribution density of graphite particles was measured as is the case with Example 1.

Furthermore, a fixing device was produced as is the case with Example 1 except for the use of the heater including the heater substrate with the surface layer produced under the above-described film formation conditions, and was used for paper passing durability tests. As a result, the noise was not generated even when the time spent in the fixing operation was 500 hours or longer. Accordingly, the durability life was evaluated as 500 hours or longer.

Example 4

As is the case with Example 1, an amorphous carbon film containing graphite particles was formed. However, the current from the vacuum arc power supply 54 was controlled to 50 A and the bias voltage applied to the plasma pipeline 56 was controlled to 5 V. Furthermore, as a baffle shape, the shape C illustrated in FIG. 6 was used.

For a surface layer produced under the above-described film formation conditions, the distribution density of graphite particles was measured as is the case with Example 1.

Furthermore, a fixing device was produced as is the case with Example 1 except for the use of the heater including the heater substrate with the surface layer produced under the above-described film formation conditions, and was used for paper passing durability tests. As a result, the noise was not generated even when the time spent in the fixing operation was 500 hours or longer. Accordingly, the durability life was evaluated as 500 hours or longer.

Example 5

The film forming apparatus illustrated in FIG. 5B was used to form an amorphous carbon film containing graphite particles, on the heater substrate 211 illustrated in FIG. 3, as a surface layer.

Specifically, the vacuum arc power supply 64 was used to allow a graphite target to cause arc discharge, and resultant carbon ions were carried into the vacuum chamber 61 to form an amorphous carbon film and graphite particles on the substrate.

At this time, the current from the vacuum arc power supply 64 was controlled to 50 A to control the distribution density of the graphite particles.

For a surface layer produced under the above-described film formation conditions, the distribution density of graphite particles was measured as is the case with Example 1.

Furthermore, a fixing device was produced as is the case with Example 1 except for the use of the heater including the heater substrate with the surface layer produced under the above-described film formation conditions, and was used for paper passing durability tests. As a result, noise was generated when the time spent in the fixing operation was 480 hours. Accordingly, the durability life was evaluated as 480 hours.

Comparative Example 1

As is the case with Example 1, an amorphous carbon film containing graphite particles was formed on the heater substrate. However, as a baffle shape, the shape A in FIG. 6 was used, and the current from the vacuum arc power supply 54 was controlled to 30 A and the bias voltage applied to the plasma pipeline 56 was controlled to 15 V. These film formation conditions allow the graphite particles to be trapped and removed by a filter.

For a surface layer produced under the above-described film formation conditions, the distribution density of graphite particles was measured as is the case with Example 1.

Furthermore, a fixing device was produced as is the case with Example 1 except for the use of the heater including the heater substrate with the surface layer produced under the above-described film formation conditions, and was used for paper passing durability tests. As a result, noise was generated when the time spent in the fixing operation was 285 hours. Accordingly, the durability life was evaluated as 285 hours.

Table 1 shows the density of graphite particles, the thickness of the surface layer, and the results for durability in Examples 1 to 5 and Comparative Example 1.

TABLE 1

| | Graphite particles | | | |
|---|---|---|---|---|
| | Minimum diameter (μm) to maximum diameter (μm) | Distribution density (the number of graphite particles/mm$^2$) | Thickness of surface layer (μm) | Durability life of fixing device |
| Example 1 | 0.19-3.10 | 50 | 0.5 | 500 hours or longer |
| Example 2 | 0.19-3.10 | 200 | 0.5 | 500 hours or longer |
| Example 3 | 0.19-3.10 | 500 | 0.5 | 500 hours or longer |
| Example 4 | 0.19-3.10 | 1000 | 0.5 | 500 hours or longer |
| Example 5 | 0.19-3.10 | 2000 | 0.5 | 480 hours |
| Comparative Example 1 | 0.19-3.10 | 15 | 0.5 | 285 hours |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-114926, filed Jun. 15, 2018, and Japanese Patent Application No. 2019-080722, filed Apr. 22, 2019, which are hereby incorporated by reference herein in their entirety.

What is claimed is:

1. A fixing device comprising a cylindrical fixing belt and a heater, the heater being disposed so as to contact with an inner surface of the cylindrical fixing belt, the fixing belt including a resin layer forming an inner circumferential surface contactable with the heater, the heater having a surface layer forming a sliding surface sliding with the inner surface of the cylindrical fixing belt, the surface layer being constituted by an amorphous carbon film containing graphite particles, the sliding surface including protrusions derived from the graphite particles, and the protrusions having a distribution density of 50 to 2000 per 1 square millimeter on the sliding surface.

2. The fixing device according to claim, 1, wherein the graphite particles have a diameter of 0.19 μm to 3.1 μm.

3. The fixing device according to claim 1, wherein the graphite particles are present on a surface of the amorphous carbon film and are discretely distributed.

4. The fixing device according to claim 1, wherein the surface layer has a thickness of 0.20 μm to 0.90 μm.

5. The fixing device according to claim 4, wherein the surface layer has a thickness of 0.35 μm to 0.65 μm.

6. The fixing device according to claim 1, wherein the resin layer is a polyimide resin layer.

7. An image forming apparatus comprising a fixing device heating an unfixed toner image formed on a recording material to fix the toner image to the recording material, the fixing device comprising a cylindrical fixing belt and a heater, the fixing belt including a resin layer forming an inner circumferential surface contactable with the heater, the heater including a surface layer forming a sliding surface sliding on the fixing belt, the surface layer being an amorphous carbon film containing graphite particles, the sliding surface including protrusions derived from the graphite particles, and the protrusions having a distribution density of 50 to 2000 per 1 square millimeter of the sliding surface.

* * * * *